US005307989A

United States Patent [19]

Dyer

[11] Patent Number: 5,307,989

[45] Date of Patent: May 3, 1994

[54] TWO WAY MAILER WITH EXTERNAL "INSERT"

[75] Inventor: Michael C. Dyer, Gurnee, Ill.

[73] Assignee: Moore Business Forms, Inc., Grand Island, N.Y.

[21] Appl. No.: 903,280

[22] Filed: Jun. 24, 1992

[51] Int. Cl.[5] ..... B65D 27/06

[52] U.S. Cl. ..... 229/305; 229/304; 229/306; 229/314

[58] Field of Search ..... 229/300, 301, 303, 304, 229/305, 306, 313, 314

[56] References Cited

U.S. PATENT DOCUMENTS

| | | | |
|---|---|---|---|
| 2,669,464 | 2/1954 | Lay et al. | 282/25 |
| 3,133,752 | 5/1964 | Schumacher | 282/25 |
| 3,184,150 | 5/1965 | Hubbard | 229/73 |
| 3,411,699 | 11/1968 | Pine et al. | 229/303 X |
| 3,977,597 | 8/1976 | Wise et al. | 229/73 |
| 4,632,427 | 12/1986 | Angus | 282/11.5 R |
| 4,715,531 | 12/1987 | Stewart et al. | 229/73 |
| 5,011,069 | 4/1991 | Bowen et al. | 229/69 |
| 5,110,043 | 5/1992 | Ashby | 229/304 |
| 5,169,061 | 12/1992 | Buescher | 229/305 |

FOREIGN PATENT DOCUMENTS

| | | | |
|---|---|---|---|
| 1066236 | 11/1979 | Canada | 229/305 |

*Primary Examiner*—Allan N. Shoap
*Assistant Examiner*—Jes F. Pascua
*Attorney, Agent, or Firm*—Nixon & Vanderhye

[57] ABSTRACT

A return mailer type business form has a top ply through which outgoing address information is visible, and a second ply with a reply address printed on its back. The back of the second ply is covered by a removable third ply when used as an outgoing mailer. After receipt by the addressee, the first ply is detached along a perforation line on the first face, and a flap on the second ply is folded about a score line to close the reply envelope formed by the remaining part of the top ply and the second ply, and to cover any further outgoing address information visible by viewing the first ply. The outgoing address information may be printed on the second ply and visible through a window in the first ply, or may be printed on the first ply.

18 Claims, 3 Drawing Sheets

TWO WAY MAILER WITH EXTERNAL "INSERT"

BACKGROUND AND SUMMARY OF THE INVENTION

Mailers are a very common type of business form. Numerous conventional mailers exist, however some of such conventional mailers have been rendered obsolete by restriction imposed by the United States Postal Service concerning the placement of the address information on mailers. Also, many manufacturers of computer printers are placing restrictions on the thickness of forms that can be handled by the printers. Many new printers are unable to handle the traditional self-mailer product, but require reduced thickness mailers.

According to the present invention, a return mailer business form is provided which overcomes the drawbacks set forth above. That is according to the present invention, a return mailer form is provided which meets all U.S. Postal Service regulations and recommendations for proper addressing and mailing. Also the form processes smoothly through a wide variety of printers, including those that cannot handle conventional mailers. The form is also less expensive compared to conventional mailers, and legibility is improved due to a decrease in the number of parts, and the amount of paper to be discarded is drastically reduced.

According to one aspect of the present invention a return mailer is provided which comprises the following parts: A first ply having a first face and a second face, and outgoing address indicia visible when viewing a first portion of the first face, and extending in a first direction. A first line formed in the first ply intersecting the outgoing address indicia. A second ply having a first face and a second face, the first face of the second ply in face to face contact with the second face of the first ply. A second line formed in the second ply in alignment with the first line, and defining a first part of the second ply, and a second part of the second ply, the first part of the second ply having a length in the first direction sufficient so that when it is folded over the first ply about the second line it completely covers any remaining outgoing address indicia visible when viewing the first ply. Reply address information printed wholly on the second face of the second part of the second ply. Means for attaching the first and second plies together to form a reply envelope. And, a third ply removably attached to the second ply to cover the second ply second face second portion, and when removed exposing the reply address.

According to a first embodiment of the present invention, the outgoing address indicia described above is printed on the second ply first face, and is visible through a window formed in the first ply at the first portion thereof, and the line of weakness in the first ply is a perforation (essentially bisecting the outgoing address area). A sealing agent, such as a piece of transfer tape or rewettable adhesive, is formed on the second ply first portion of the first face for sealingly engaging the first ply first face when the second ply is folded about the second line—which preferably is a score line.

Alternatively, according to a second embodiment, the outgoing address indicia may be printed on the first ply first face by utilizing a fly sheet with a carbon spot, or like imaging material, on the back of it to print the outgoing address on the first ply.

According to the first embodiment of the invention the return mailer thus comprises: A top ply having a window, and having a first, outer, face, and a second, interior, face. A second ply cooperating with the top ply and having a first, inner, face cooperating with the top ply second face, and having outgoing address information printed thereon beneath the window, and visible through the window, and extending in a first direction; and a second face having reply indicia printed thereon. A score line formed in the second ply and defining a flap portion, and a body portion, the reply address indicia being provided wholly in the body portion. A sealing agent disposed on the second ply first face on an endmost area of the flap portion. The flap portion having a length sufficient, when the second ply is folded about the score line and attached by the sealing agent to the top ply, to completely cover an outgoing address indicia on the second ply first face, and any portion of the window of the top ply. Adhesive means for attaching the top and second plies together to form an outgoing and reply envelope. And, means for removably covering the reply address indicia on the second ply when the mailer is used as an outgoing mailer.

The second embodiment of return mailer according to the present invention thus comprises the following elements: A top ply having outgoing address information printed on a first face thereof, and extending in a first direction, the top ply also having a second, interior, face. A second ply cooperating with the top ply and having a first, inner, face cooperating with the top ply second face, and a second face having reply indicia printed thereon. A score line formed in the second ply and defining a flap portion, and a body portion, the reply address indicia being provided wholly in the body portion. A sealing agent disposed on the second ply first face on an endmost area of the flap portion. The flap portion having a length sufficient, when the second ply is folded about the score line, to completely cover any outgoing address indicia on the top ply. Adhesive means for attaching the top and second plies together to form an outgoing and reply envelope And, means for removably covering the reply address indicia on the second ply when the mailer is used as an outgoing mailer.

It is the primary object of the present invention to provide a simple, relatively thin, mailer which meets all U.S. Postal requirements regarding proper addressing and mailing. This and other objects of the invention will become clear from an inspection of the detailed description of the invention and from the appended claims.

DETAILED DESCRIPTION OF THE DRAWINGS

Figure 5:
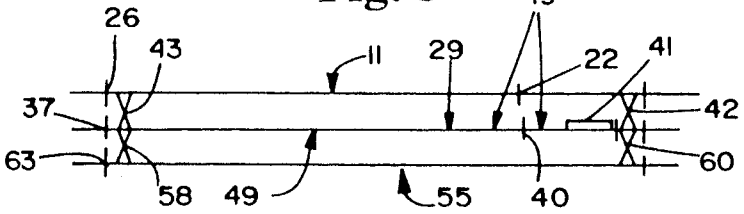
FIG. 5 is a cross-sectional schematic illustrating the plies of FIGS. 1 through 4 constructed into a first embodiment of mailer according to the invention.

A return mailer according to the present invention is shown schematically in FIG. 5, with the various component parts illustrated in FIGS. 1 through 4. The first component of the mailer comprises a first ply 11 having a first face 12 and a second face 13 (see FIG. 1), side edges 14, 15 and top and bottom edges 16, 17. An outgoing address indicia 19 is visible when one views a first portion of the first face, the outgoing address 19 extending in a first direction (from left to right in FIG. 1). The outgoing address 19 preferably has bar code information or the like, as illustrated at 32 in FIG. 2, and is visible through a die cut window 20 in the ply 11, which may have a transparent window patch 21 thereon. A first line 22—in this embodiment the line 22 being a perforation line or a like line of weakness—is formed in the first ply 11 intersecting the outgoing address indicia 19.

The first ply 11 also may include a notch 23 provided at the edge 16 at the perforation line 22 to facilitate tearing of the ply 11 along the perforation 22. Perforation lines 25, 26 are also preferably provided spaced from, and parallel to, the side edges 14, 15.

The second ply 29 (see FIGS. 2 and 3) has a first face 30 with a self-imaging area 31 on which the outgoing address 19, including bar code 32 thereof, is formed. Adhesive patterns 33 are provided along the top and bottom edges for connecting the second ply 29 to the first ply 11. The ply 29 includes side edges 34, 35, with perforations 36, 37 in alignment with the perforations 25, 26 of the first ply 11. The second ply 29 has virtually an identical size and shape (quadrate) as the first ply 11.

The second ply 29 also includes a perforation line 38, and may contain a notch 39 providing easy access to it, and a second line 40, in this case a score line, about which the ply 29 may be folded. A sealing agent 41 (rewettable glue, or transfer tape (not shown)) is provided on a portion of the second ply 29 between the perforation 38 and the score line 40, adjacent the perforation 38, for sealing the return envelope. Adhesive strips 42 and 43 are also provided, the adhesive strip 42 holding the first and second plies 11, 29 together until perforation 38 is detached, and the adhesive strip 43 forming one side of the return envelope which is formed by the first and second plies 11, 29.

Figure 1:
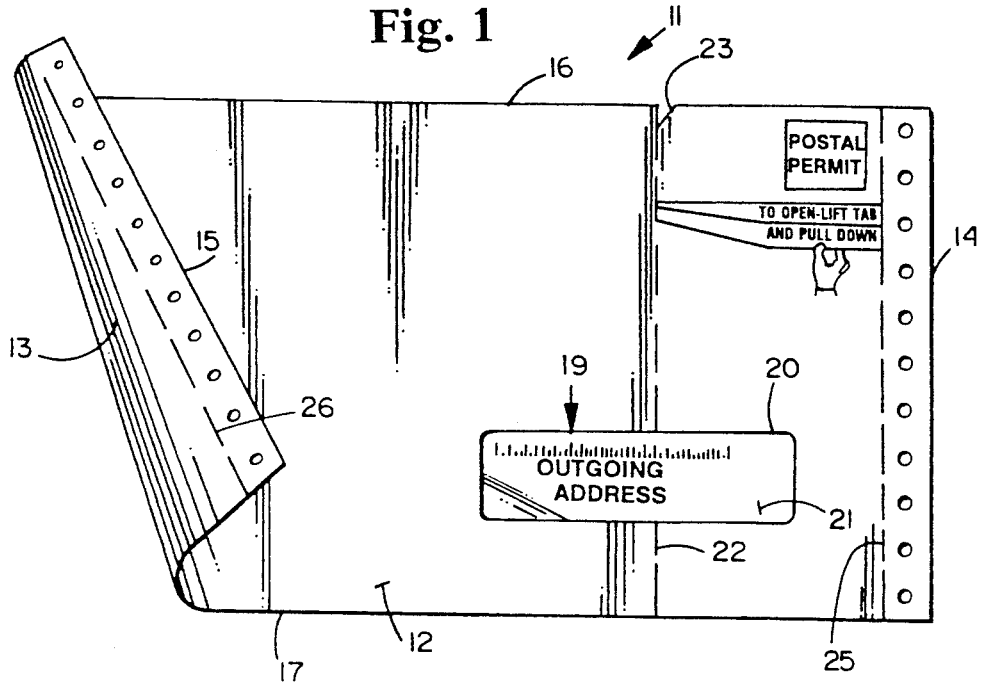
FIG. 1 is a top plan view, with one side curled back for clarity of illustration, of the first ply of a first embodiment of mailer according to the present invention.
Figure 2:
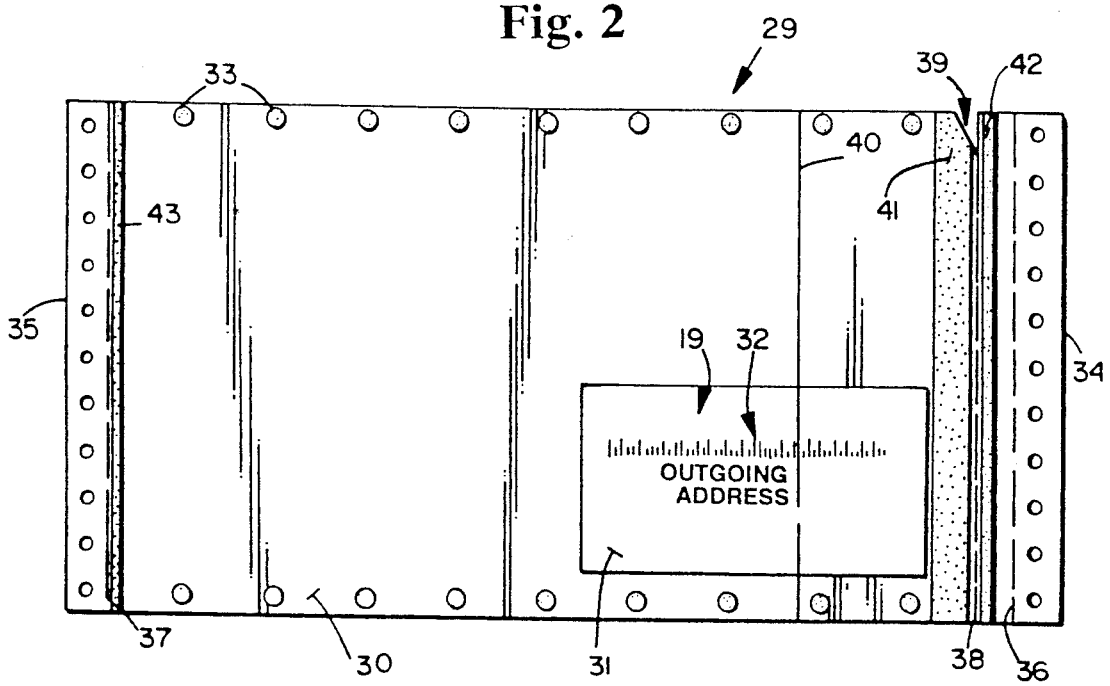
FIG. 2 is a top plan view of the second ply of the first embodiment of mailer according to the invention.
Figure 3:
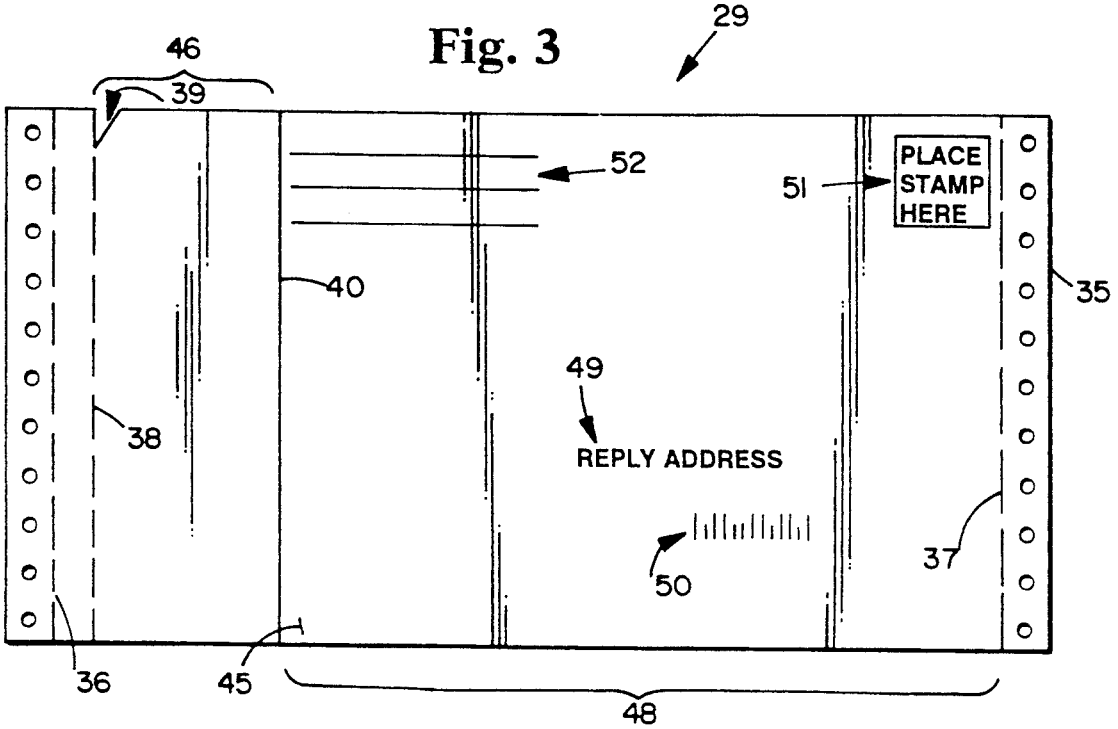
FIG. 3 is a bottom plan view of the second ply of FIG. 2.
Figure 4:
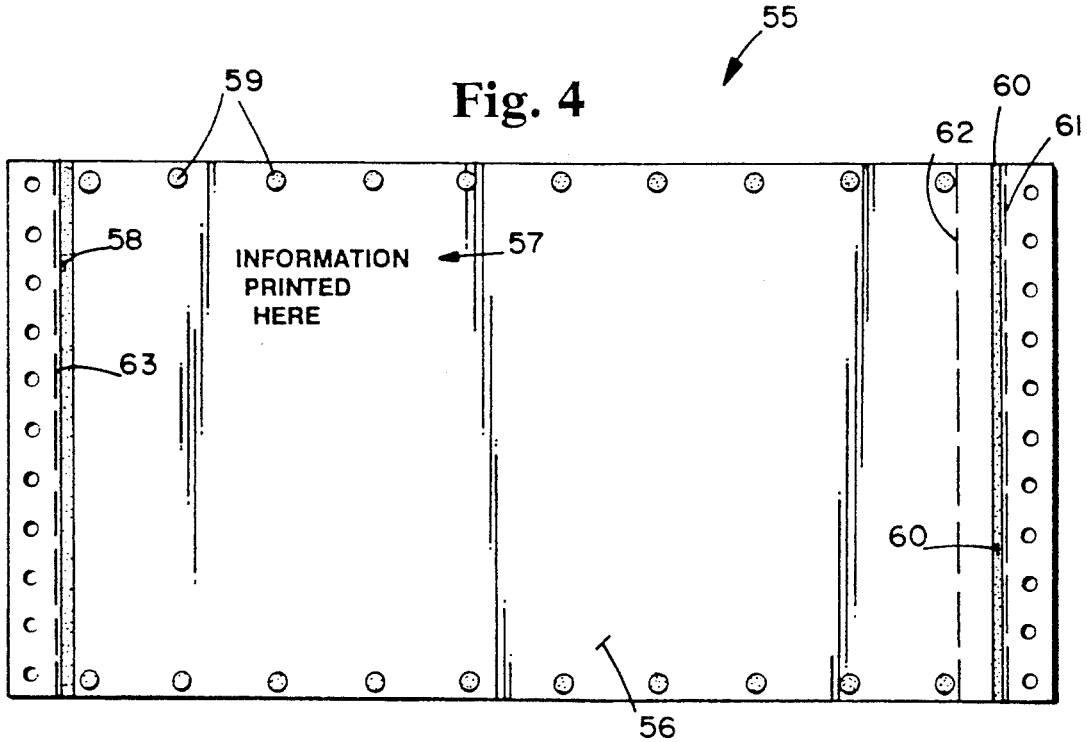
FIG. 4 is a top plan view of the third ply of mailer according to the first embodiment.

The second ply 29 also includes a second face 45, as illustrated in FIG. 3, the score line 40 and perforation 38 defining a first part (flap portion) 46 of the second ply 29, while the score line 40 and perforation 37 define a second part (body portion) 48 of the second ply 29. Note that the first part (flap portion) 46 has a length (the dimension from the perforation 38 toward the score line 40) sufficient so that when it is folded over about the score line 40, over the first ply 11 (after detachment at the perforation 22) it completely covers any remaining outgoing address indicia 19 visible when viewing the first ply 11. The sealing agent 41 then holds it in place once it is folded about the score line 40 to close the return envelope formed thereby. Note that the line 40 is in alignment with though slightly offset from the perforation 22 when the return mailer is assembled in its outgoing configuration (FIG. 5).

The second ply 29 also includes reply address indicia 49, which may include bar coding 50, and may also include a place for placing a stamp 51, and printed lines for a return address 52, on a second face 45 of the second ply 29. The adhesive 33, 43 —and ultimately the sealing agent 41—cooperate to form the return envelope.

The return mailer in the first embodiment also comprises a third ply 55 (FIG. 4) which is removably attached to the second ply 29 to cover the second ply second face 45, but when removed exposing the reply address 49. The third ply 55 has a first face 56 which—in the outgoing configuration of the mailer (FIG. 5)—engages the second face 45 of the second ply 29. The third ply 55 may be tinted so that the reply address 49 is not easily readable through it. Also the third ply 55 is illustrated having the same size and shape as the second ply 29, but it can be shorter if desired, just so that it is large enough to cover all of the return address characters 49 through 51. If a shorter fluid ply is utilized, some means of adhesive should be used to secure the short sheet to the second face of record ply 45.

There is also a second face of the third ply 55 (not shown) opposite the face 56. Information for the outgoing addressee 57 may be printed on the third ply first face 56. Adhesive strip 58 and adhesive pattern 59, and adhesive 60 normally hold the third ply 55 in place covering the reply address 49 until removed. Perforation lines 61, 62, and 63 are provided, which are in alignment with the perforations 36, 38, and 37 respectively of the second ply 29.

In use of the mailer of FIGS. 1 through 5, in its outgoing configuration of FIG. 5 when it is mailed out, the outgoing address 19, 32 is clearly visible from the top of the first ply 11, and no other address information is visible When the mailer is received by the addressee, he/she detaches the undesired portion of the first ply 11 using the notch 23 and separating it at the perforation 22, and removes the unwanted portion of the second ply 29 by using the notch 39 and detaching along the perforation 38. At the same time, the third ply is detached at the perforation 62, and the edge of the third ply is grabbed and the entire third ply 55 is removed from cooperation with the second ply 29, exposing the reply address 49, 50 on the back face 45 of the second ply 29. The information 57 is read by the outgoing addressee, and when he/she is then ready to return the reply envelope, after insertion of any desired sheets between the plies 11, 29, the second ply 29 is folded about the score line 40, the rewettable adhesive 41 is wet (or the transfer tape has the release covering removed), and the first part 46 of the second ply 29 is folded about the score line 40 until the adhesive/sealing agent 41 engages the face 12 of the first ply 11, thus completing the return envelope. A stamp may be placed at place 51, and then the envelope is mailed to the reply address 49, 50.

Figure 6:
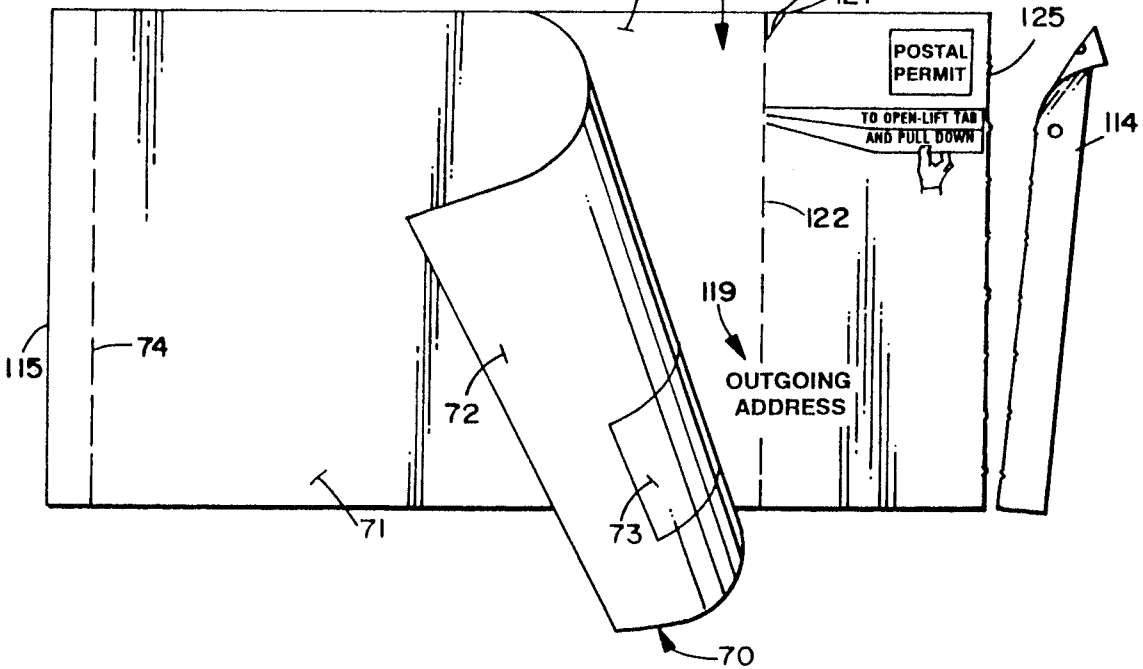
FIG. 6 is a top plan view, with portions separated or turned back for clarity of illustration, of the second embodiment of return mailer according to the invention.

A second embodiment according to the invention is illustrated in FIG. 6. In this embodiment structures comparable to those in the FIGS. 1 through 5 embodiment are shown by the same reference numerals only preceded by a "1".

The only significant differences between the FIG. 6 and FIGS. 1 through 5 embodiment is the provision of a fly sheet 70 having a top face 71 and a bottom face 72, in association with the rest of the components, making a window 20, 21 unnecessary. Fly sheet 70 has a carbon spot 73 or like image transfer material disposed on the back face 72, and may contain perforations at 74 and 125. When the fly sheet 70 is impacted, the outgoing address 119 is transferred from the impacting stylus through the carbon spot 73 onto the front face 112 of a first ply 111, so that no window is needed in the first ply 111. The second ply 129, and the third ply 155, are the same as in the FIGS. 1 through 5 embodiment. Separation and reuse as a return envelope are also the same.

It will thus be seen that according to the present invention a return mailer business form is provided which meets all the U.S. Postal Service regulations and recommendations for proper addressing and mailing, only one address being visible at any one time on the form. The form is also inexpensive compared to conventional mailers, and is relatively thin so that it passes more smoothly through a wider variety of printers than a conventional mailer. However should it ever be desired to provide more parts, they may simply be added to the back of the third ply 55. The form according to the invention also provides enhanced legibility of data since it normally has decreased parts compared to conventional mailers, and the amount of paper to be discarded is drastically reduced compared to conventional mailers.

While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent structures and products.

What is claimed is:

1. A return mailer comprising:

a first ply having a first face and a second face, and outgoing address indicia visible when viewing a first portion of said first face, and extending in a first direction;

a first line formed in said first ply intersecting said outgoing address indicia;

a second ply having a first face and a second face, said first face of said second ply in face to face contact with said second face of said first ply;

a second line formed in said second ply in alignment with said first line, and defining a first part of said second ply, and a second part of said second ply, said first part of said second ply having a length in said first direction sufficient so that when it is folded over said first ply about said second line it completely covers any remaining outgoing address indicia visible when viewing said first ply;

reply address information printed wholly on said second face of said second part of said second ply;

means for attaching said first and second plies together to form a reply envelope;

a third ply removably attached to said second ply to cover said second ply second face second portion, and when removed exposing said reply address; and wherein said outgoing address indicia is printed on said second ply first face, and is visible through a window formed in said first ply at said first portion thereof.

2. A mailer as recited in claim 1 wherein said first line in said first ply is a perforation.

3. A mailer as recited in claim 1 further comprising a sealing agent formed on said second ply first portion first face for sealingly engaging said first ply first face when said second ply is folded about said second line.

4. A mailer as recited in claim 3 wherein said sealing agent is a piece of tape covered with a release material, or rewettable adhesive.

5. A mailer as recited in claim 3 wherein said second line is a score line.

6. A mailer as recited in claim 1 wherein said outgoing and reply address indicia include bar coding.

7. A mailer as recited in claim 1 further comprising self-imaging material formed on said second ply second face beneath said window.

8. A mailer as recited in claim 1 wherein said outgoing address indicia is printed on said first ply first face.

9. A mailer as recited in claim 8 further comprising a fly sheet overlying and detachable from said first ply.

10. A mailer as recited in claim 1 wherein said means for attaching said first and second plies together comprises adhesive means, and wherein said first line extends in a second direction generally perpendicular to said first direction.

11. A mailer as recited in claim 1 wherein said third ply is connected to said second ply by widely spaced dots of adhesive, so that said third ply is readily removably from said first ply.

12. A mailer as recited in claim 1 wherein said third ply is tinted so that the reply address on said second ply second face is not easily readable therethrough.

13. A mailer as recited in claim 1 wherein said third ply has substantially the same size as said second ply.

14. A mailer as recited in claim 1 wherein said third ply has a first face in releasable contact with said second ply second face, and a second face; and further comprising information indicia for the outgoing addressee printed on said third ply first face.

15. A mailer as recited in claim 1 further comprising a notch formed in an edge of said first ply at said first line to allow the outgoing addressee to easily detach said first ply at said first line.

16. A mailer as recited in claim 1 further comprising edge configurations of said first, second, and third plies connected together at edges thereof nearest and parallel to said first line, and perforations formed in said first, second at third plies at said connected edges to allow ready detachment of said edge configurations from the rest of said first, second, and third plies.

17. A mailer as recited in claim 16 further comprising a notch formed in an edge of said second ply at said perforation in said second ply to allow said second ply edge configuration to easily detach at said second ply perforation.

18. A return mailer, comprising:

a top ply having a window, and having a first, outer, face, and a second, interior, face;

a second ply cooperating with said top ply and having a first, inner, face cooperating with said top ply second face, and having outgoing address information printed thereon beneath said window, and visible through said window, and extending in a first direction; and a second face having reply indicia printed thereon;

a score line formed in said second ply and defining a flap portion, and a body portion, said reply address indicia being provided wholly in said body portion;

a sealing agent disposed on said second ply first face on an endmost area of said flap portion;

said flap portion having a length sufficient, when said second ply is folded about said score line and attached by said sealing agent to said top ply, to completely cover an outgoing address indicia on said second ply first face, and any portion of said window of said top ply;

adhesive means for attaching said top and second plies together to form an outgoing and reply envelope; and means for removably covering said reply address indicia on said second ply when said mailer is used as an outgoing mailer.

* * * * *